US008882262B2

(12) United States Patent
Roof et al.

(10) Patent No.: US 8,882,262 B2
(45) Date of Patent: Nov. 11, 2014

(54) BELT LEVELING APPARATUS AND SYSTEMS FOR SIMULTANEOUS LEVELING AND PINNING OF RADIATION CURABLE INKS

(75) Inventors: Bryan J. Roof, Newark, NY (US); David J. Gervasi, Pittsford, NY (US); James Padula, Webster, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 57 days.

(21) Appl. No.: 13/525,239

(22) Filed: Jun. 15, 2012

(65) Prior Publication Data

US 2012/0314012 A1 Dec. 13, 2012

Related U.S. Application Data

(63) Continuation-in-part of application No. 12/256,670, filed on Oct. 23, 2008, now Pat. No. 8,231,214.

(51) Int. Cl.
*B41J 2/01* (2006.01)
*B41J 11/00* (2006.01)

(52) U.S. Cl.
CPC ..... *B41J 11/002* (2013.01)
USPC ..... 347/104

(58) Field of Classification Search
USPC ..... 347/102, 104
See application file for complete search history.

(56) References Cited

U.S. PATENT DOCUMENTS

| | | | | |
|---|---|---|---|---|
| 3,874,962 | A | 4/1975 | Gersbeck et al. | |
| 5,267,005 | A | 11/1993 | Yamamoto et al. | |
| 6,257,708 | B1 * | 7/2001 | Bern | 347/55 |
| 6,468,463 | B1 * | 10/2002 | Osawa | 264/328.1 |
| 6,494,570 | B1 | 12/2002 | Snyder | |
| 6,513,909 | B1 * | 2/2003 | Elrod et al. | 347/55 |
| 6,846,852 | B2 * | 1/2005 | Allen et al. | 522/99 |
| 6,923,533 | B2 | 8/2005 | Pan et al. | |
| 7,887,176 | B2 | 2/2011 | Kovacs et al. | |
| 2002/0158963 | A1 | 10/2002 | Dietze | |
| 2003/0103123 | A1 | 6/2003 | Snyder | |
| 2006/0077246 | A1 | 4/2006 | Kawakami et al. | |
| 2006/0103709 | A1 | 5/2006 | Burdenko et al. | |
| 2006/0290760 | A1 | 12/2006 | German et al. | |
| 2007/0120921 | A1 | 5/2007 | Carlini et al. | |
| 2007/0120930 | A1 | 5/2007 | Domoto et al. | |
| 2007/0292175 | A1 * | 12/2007 | Shinshi | 399/329 |
| 2008/0024577 | A1 * | 1/2008 | Nakano et al. | 347/102 |

(Continued)

FOREIGN PATENT DOCUMENTS

JP 2005-173441 6/2005

OTHER PUBLICATIONS

Bryan J. Roof, U.S. Appl. No. 12/256,670, filed Oct. 23, 2008.
Bryan J. Roof, U.S. Appl. No. 13/525,232, filed Jun. 15, 2012.

*Primary Examiner* — Charlie Peng
(74) *Attorney, Agent, or Firm* — Ronald E. Prass, Jr.; Prass LLP

(57) ABSTRACT

Systems for leveling UV-curable gel ink include a leveling belt member having a TEFLON FEP inner layer and a conformable silicone outer layer. A UV source is disposed to direct light through the belt onto a substrate at a leveling or pressure nip defined by the leveling beltz tube and a backing member such as a backing belt and chilled platen.

7 Claims, 6 Drawing Sheets

(56) References Cited

U.S. PATENT DOCUMENTS

2008/0094459 A1* 4/2008 Sakagami ..... 347/102
2008/0122914 A1 5/2008 Toma et al.
2010/0033545 A1 2/2010 Caiger et al.
2010/0177151 A1* 7/2010 Thompson et al. ..... 347/102
2010/0212821 A1 8/2010 Grinberg

* cited by examiner

BELT LEVELING APPARATUS AND SYSTEMS FOR SIMULTANEOUS LEVELING AND PINNING OF RADIATION CURABLE INKS

RELATED APPLICATIONS

This application is a continuation-in-part of U.S. patent application Ser. No. 12/256,670, filed Oct. 23, 2008, now U.S. Pat. No. 8,231,214 entitled "METHOD AND APPARATUS FOR FIXING A RADIATION-CURABLE GEL-INK IMAGE ON A SUBSTRATE," the disclosure of which is incorporated by reference herein in its entirety. This application is related to co-pending U.S. patent application Ser. No. 13/525,232 entitled "QUARTZ TUBE LEVELING APPARATUS AND SYSTEMS FOR SIMULTANEOUS LEVELING AND PINNING OF RADIATION CURABLE INKS," the disclosure of which is incorporated by reference herein in its entirety.

FIELD OF DISCLOSURE

The disclosure relates to printing with radiation-curable inks. In particular, the disclosure relates to leveling radiation curable gel ink on a substrate using a quartz leveling member having a conformable surface layer.

BACKGROUND

US Patent Application Publication US 2008/0122914 A1 discloses compositions for an ultraviolet (UV)-curable ink suitable for use in ink-jet printing. Such inks include one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

US Patent Application Publication U.S. 2007/0120930 A1 discloses a printing apparatus suitable for use with a radiation-curable ink. The apparatus uses a "transfuse" system, wherein ink forming the desired image is first jetted onto an image receptor in the form of a belt, and then transferred from the image receptor onto a print sheet or other substrate. At various locations along the belt path are disposed ultraviolet radiation sources for partially hardening the ink on the belt before transferring to the print sheet.

Although the above-described apparatus uses an image receptor to apply ink to a print sheet, it would be desirable to provide a system where such an ink as above described could be applied directly to a print sheet or other substrate. One challenge to such a system is that, in practical applications, such inks tend to have a "mayonnaise" consistency at room temperature, but when heated incidental to jetting, change to a low viscosity liquid. A typical ink-jet printing process heats the ink until it is liquid and then directly fires ink droplets from a piezoelectric print head onto the substrate. Once the ejected ink hits the substrate, it changes phase from the liquid back to its more viscous consistency, thereby reducing its penetration into porous media. Once this ink is exposed to UV radiation, photoinitiators in the ink are bombarded with UV radiation and the incident flux converts the monomers present in the ink into a cross linked polymer matrix resulting in a very hard and durable mark on the paper.

However, there is a desire to have the ink leveled prior to having it UV cured. The reason for this is so that gloss is more uniform, missing jets can be masked, and certain applications such as packaging require thin layers of relatively constant thickness. Because these inks have a mayonnaise consistency at room temperature, they have very little cohesive strength prior to curing. In addition, the inks are typically designed to have good affinity to many materials. This means that conventional methods for flattening a layer of ink tend to fail, because the ink splits and leaves much of the image behind on the device trying to flatten it, such as a traditional fuser roll as familiar in xerography. Before the ink ejected onto the substrate is cured, it is desirable to level the ink so that gloss is more uniform, missing jets may be masked, and/or certain applications such as packaging may be accommodated by enabling formation of thin ink layers of relatively constant thickness across the surface of the substrate.

SUMMARY

Apparatus and systems for fixing ink on a substrate are disclosed. A leveling member is positioned to contact an ink-bearing side of the substrate at a nip. A first radiation source is positioned to direct radiation to the ink-bearing side of the substrate at the nip, the radiation suitable for curing the ink on the substrate, which may be paper, Mylar, foil, etc.

In an embodiment, a leveling apparatus useful for printing radiation curable ink on a substrate may include a leveling belt, the leveling belt having an inner layer and an outer layer, the outer layer forming a conformable belt surface for contacting a radiation curable ink-bearing side of the substrate at a leveling nip. Apparatus may include the inner layer further comprising fluorinated ethylene propylene. Apparatus may include the outer layer further comprising silicone.

In an embodiment, apparatus may include the outer layer may comprising a conformable surface coating having silicone, a reinforcing filler, and a reinforcing resin. The reinforcing filler may include nanocrystalline silica. The reinforcing resin may include a highly-branched siloxane. The reinforcing filler may include fumed silica.

In an embodiment, apparatus may include a light source configured to emit light through the belt at the leveling nip. The light source may be an ultra-violet light source for curing radiation curable ink. The light source may include a light-emitting diode array. The light source may be configured to emit light having a wavelength of 395 nm for pinning radiation curable ink.

In an embodiment, apparatus may include a plurality of support rolls configured to entrain the belt, the plurality of rolls including a tension roll. The plurality of rolls may include a dampening system backing roll. The plurality of rolls may include a cooling roll. The cooling roll may be a heat pipe, for example. At least two of the plurality of rolls may be configured to support the belt to form a leveling nip. The light source may be disposed so that the belt interposes the light source and the leveling nip, the light source being configured to emit light through the belt at the leveling nip.

In an embodiment, systems for leveling radiation curable gel ink on a substrate may include a leveling belt, positioned to contact a radiation curable ink-bearing side of the substrate at a pressure nip; and a backing member, the backing member being a belt positioned to apply pressure to the leveling belt at the pressure nip for leveling radiation curable gel ink on a substrate. Systems may include a first plurality of rolls configured to entrain the leveling belt, the first plurality of rolls including a cooling roll, positioned at a pressure nip exit, and a tension roll; and a second plurality of backing rolls configured to entrain the backing belt. Systems may include a chilled platen configured to contact the leveling belt, the backing belt interposing the platen and the leveling belt for producing a desired pressure profile at the pressure nip.

In an embodiment, systems may include the leveling belt further comprising an inner layer comprising TEFLON fluorinate ethylene propylene; and an outer layer comprising silicone, the belt configured whereby the outer layer contacts an ink-bearing side of a substrate at the pressure nip. The outer layer may include a surface coating comprises silicone, a reinforcing filler, and a reinforcing resin, the reinforcing filler comprising nanocrystalline silica, and the reinforcing resin comprising a highly-branched siloxane.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
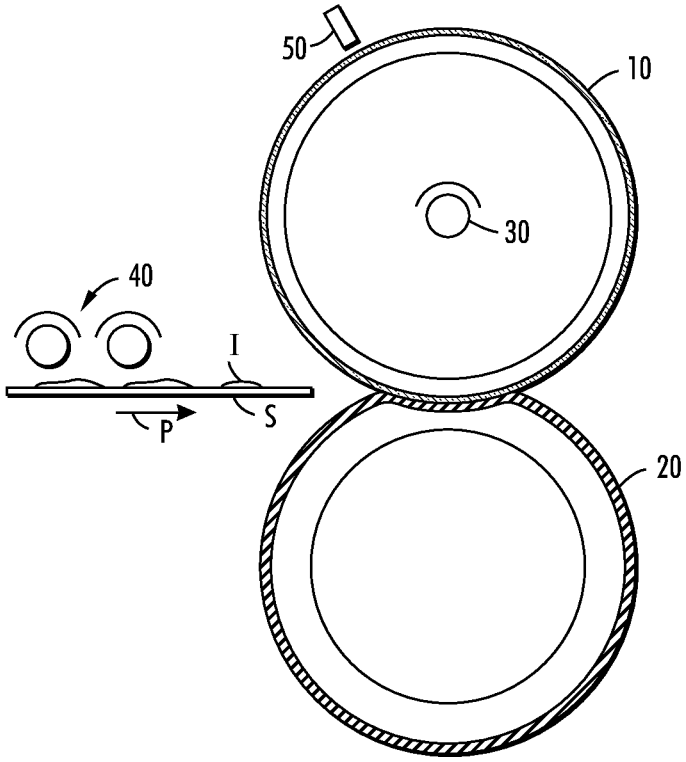
FIG. 1 is a simplified elevational view of a fixing apparatus, as would be found in a larger printing apparatus, according to a first embodiment.

Exemplary embodiments are intended to cover all alternatives, modifications, and equivalents as may be included within the spirit and scope of the apparatus and systems as described herein.

Reference is made to the drawings to accommodate understanding of leveling apparatus and systems for leveling radiation curable ink for printing. In the drawings, like reference numerals are used throughout to designate similar or identical elements. The drawings depict various embodiments related to embodiments of illustrative apparatus and systems for leveling radiation curable ink on a substrate using a belt leveling member.

FIG. 1 is a simplified elevational view of a fixing apparatus, as would be found in a larger printing apparatus, according to a first embodiment. A sheet or substrate (of any suitable material) S bearing an unfixed ink image I approaches, along a process direction P, a fixing apparatus including a rotatable member, here in the form of an ink-side leveling roller 10, and a backing member here in the form of a backing roller 20. In a practical embodiment, the ink image I comprises at this time an uncured, viscous liquid that has not significantly penetrated into the substrate S. At the nip formed between rollers 10 and 20, the unfixed ink I is mechanically "leveled" by the nip pressure, which effectively causes the various layers of multi-colored inks to assume a consistent total height relative to the surface I of substrate S.

Simultaneous with the mechanical pressure applied at the nip, radiant energy is applied to the ink I, the radiant energy including suitable wavelengths, typically UV, for chemical curing of the ink I on substrate S as any small area of substrate S passes through the nip. For this purpose there is disposed within leveling roller 10 a radiation source 30, which may include for this embodiment one or more UV lamps or a UV-emitting LED array, directing radiation to the ink I in the nip as the substrate S moves therethrough. The power of source 30 or multiple sources is such that the ink I is fully cured by the time it leaves the nip for a given process speed.

In such an embodiment, the walls of leveling roller 10 are effectively transmissive of the curing radiation, so the radiation can efficiently reach the ink I in the nip. According to possible embodiments, leveling roller 10 is comprised of a quartz core with a shrink fit release layer surface. The outer layer of leveling roller 10 is a low surface energy material that also passes UV radiation such as clear PTFE, but other alternatives, such as fluorocarbons, are available. The backing roller 20 is typically formed of silicone over metal.

Also shown in FIG. 1 are IR lamps 40, or equivalents, for pre-heating a substrate S as needed given a particular material set (ink and substrate). A temperature sensor 50 of known type can measure the surface temperature of leveling roller 10 just upstream of the nip, the recorded temperature being useful for a control system.

The curing of ink I is simultaneous with the mechanical pressure formed at the nip so that sufficient cross linking of monomer chains in the ink is initiated while still under a leveling condition such that polymerization is substantially complete by the time the image I leaves the nip formed by rollers 10 and 20. The process of polymerization results in a solid durable material that experiences some shrinkage. The shrinkage and hardness combined with the low surface energy layer on roller 10 lead to a condition whereby the image tends to self strip from the roller 10.

Figure 2:
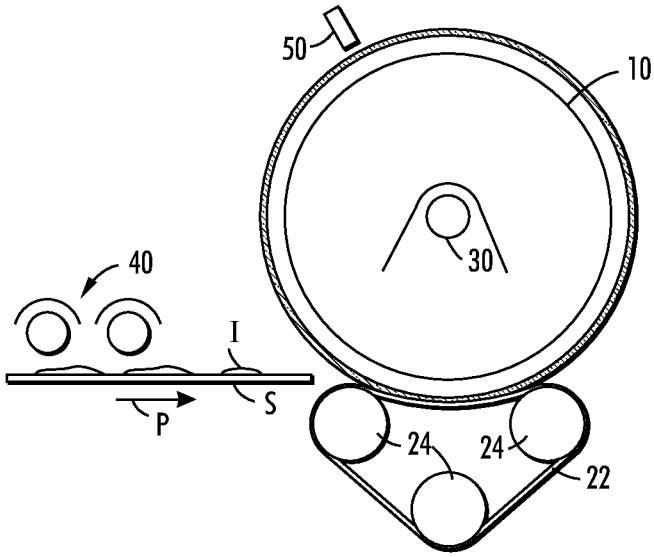
FIG. 2 is a simplified elevational view of a fixing apparatus according to a second embodiment.

FIG. 2 is a simplified elevational view of a fixing apparatus, as would be found in a larger printing apparatus, according to a second embodiment. Like reference numbers from FIG. 1 indicate analogous elements in FIG. 2. The FIG. 2 embodiment differs from FIG. 1 in that, in lieu of the backing roller, there is provided a rotatable backing belt 22, which forms a nip along a significant wrap angle around the leveling roller 10. The belt 22 can be entrained around any number of inner rollers 24 to provide a necessary nip pressure against leveling roller 10. The backing belt 22 provides a significantly longer dwell time for ink under mechanical pressure to be cured by radiation source 30. One basic composition of backing belt 22 includes polyimide with a silicone overcoat.

Figure 3:
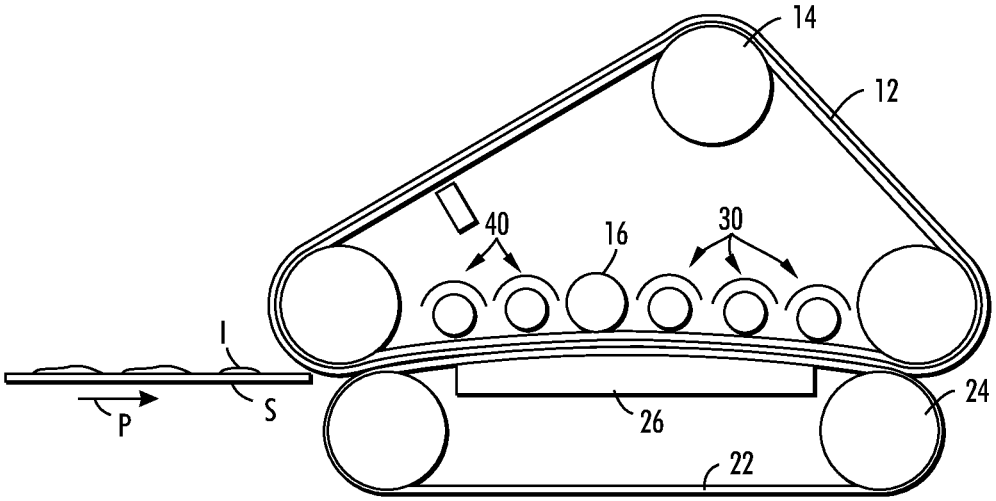
FIG. 3 is a simplified elevational view of a fixing apparatus according to a third embodiment.

FIG. 3 is a simplified elevational view of a fixing apparatus, as would be found in a larger printing apparatus, according to a third embodiment. Like reference numbers from FIG. 1 or FIG. 2 indicate analogous elements in FIG. 3. In this embodiment, in lieu of a leveling roller, there is provided a leveling belt 12, entrained on any number of inner rollers 14, forming a nip against backing belt 22. An adjustable pressure roller 16 disposed within leveling belt 22 can urge a portion of the belt, along a point in the nip, against backing belt 22, which can be supported with a pressure pad 26, as shown.

The leveling belt 12 includes multiple layers. An inner layer provides a durable surface that serves as support and a drive surface. One suitable material is a clear (to UV) polyimide. The outer layer of leveling belt 12 includes a low surface energy material that also passes UV radiation; one suitable material is clear PTFE, but other alternatives, such as fluorocarbons, are possible. The adhesive between the layers must also be effectively transmissive of UV.

The nip pressure is held constant through the length of the nip by the slightly curved pressure pad 26 inside the backing belt 22 that applies force normal to the backing belt 22, thereby pushing it into the leveling belt 12, and causing substrates S passing therethrough to be bent outward with respect to the uncured ink I thereon. The outward bending aids in the self-stripping of the ink.

Further as can be seen in FIG. 3, IR lamps 40 as described above are disposed within leveling belt 12 at an early part of the nip along the process direction P. These lamps, or equivalents, are used to bring the ink I and substrate S to a predetermined temperature prior to curing, as needed. Following the adjustable pressure roller 16, the UV sources 30 cure the ink I onto substrate S.

Although the two radiation sources in the illustrated embodiment provide first IR for heating and then UV for curing, different applications may require different arrangements of radiation sources. For example, if a plurality of inks is placed on substrate S, such as for different primary colors or other attributes such as magnetic properties, it may be desired to cure one ink (having one particular curing wavelength) before the other (having another particular curing wavelength). The radiation sources can be arranged to effect this ordered curing. Alternatively, multiple radiation sources may differ in other aspects, such as amplitude, to obtain desired print properties, such as gloss, given a particular material set.

A leveling member such as a belt for substantially simultaneous leveling and pinning ink to a substrate may be formed to include an inner layer and an outer layer comprising a clear photovoltaic encapsulate quality silicone overcoat formed over the inner layer. In radiation curable ink printing, radiation curable ink such as UV gel ink may be applied to a substrate such as paper, mylar, or foil by way of a print head in heated liquid form. After the ink contacts the paper, the ink cools, and as the ink cools, the ink gels and tends to have a mayonnaise consistency.

A leveling or pressure nip may be formed between a leveling belt and a backing member in the form of a belt, for example. The leveling belt may be a leveling member comprising multiple layers. An inner layer of the leveling belt may comprise fluorinated ethylene propylene (FEP) such as TEFLON FEP. The inner layer may be configured to provide support and form a drive surface. FEP has been found, after extensive experimentation, to be suitable for forming a leveling belt inner layer. FEP has good strength, optical clarity, and is resistant to photodegradation. For example, testing was performed on FEP samples wherein samples were measured for both tensile strength using Instron or known industry standard testing methodologies, and for transmission loss as a function of exposure to a 395 nm wavelength LED array used for pinning, i.e. curing or partially curing UV ink. To mitigate photodegradation and maintain suitable transmission characteristics of the leveling member material, an exposure device or light source may be used that emits light having relatively longer wavelengths of UV, while providing minimal shorter wavelengths of light energy. Light emitting diode or LED devices emit light in a narrow band of wavelengths, typically at 395 nm plus or minus 10 nm. The light source may be arranged to cure or partially cure ink at the leveling nip, the ink being leveled when exposed to light emitted by the light source.

For example, the light source may be arranged within a belt leveling member so that light emitted by the light source may pass through the transmissive leveling belt onto a desired region of the leveling nip defined by the belt and a backing member. Alternatively, the light source may be arranged or disposed outside of the leveling belt, and configured to emit light that passes through the transmissive belt and into the leveling nip. In such a configuration, the light source may emit light that passes through the belt at two different locations.

A light source may be disposed in leveling apparatus and systems whereby light may be emitted onto ink at a leveling nip while ink on the substrate is subject to mechanical pressure and is leveled, or in a leveled or compressed state. Accordingly, the ink may be cured while the ink is in a leveled state in the dwell region of the leveling nip. A conformable surface of the leveling belt allows for printing of uniform ink lines having acceptable, e.g., uniform gloss and no offset of the ink onto a surface of the leveling belt.

Further, one or more leveling apparatus may be implemented in systems useful for printing with radiation curable ink. For example, systems may be configured to include a plurality of leveling apparatus having a leveling belt including a hard TEFLON layer and a conformable silicone-comprising outer layer. The leveling apparatus may be arranged serially along a media path. A light source may be disposed within each belt, and may be configured to emit light onto a leveling nip defined by the belt and a backing member such as a backing belt system. Each light source of each serially arranged leveling apparatus may be configured to emit light at different respective wavelengths whereby different components of ink deposited on a substrate such as paper may be cured at respective leveling nips of the plurality of leveling apparatus.

Figure 4:
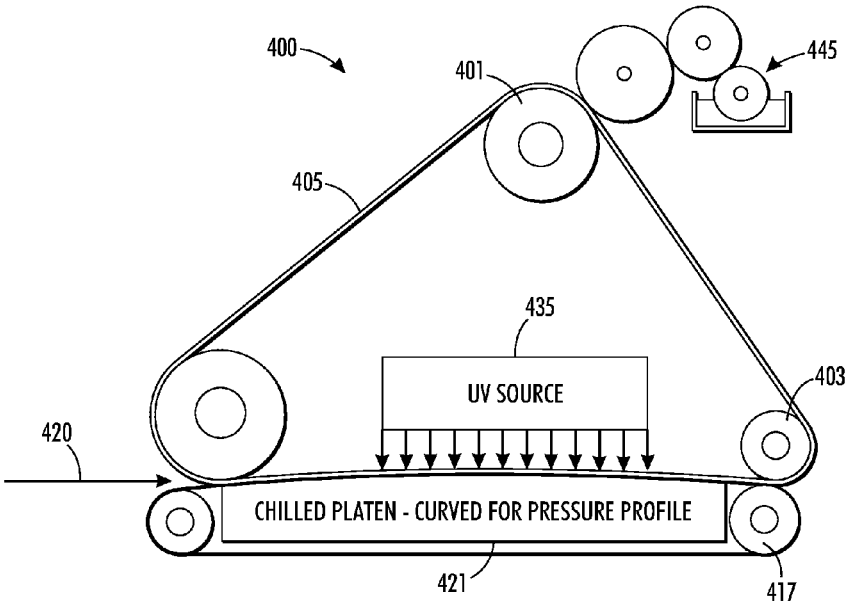
FIG. 4 shows a diagrammatical side view of belt leveling apparatus and system in accordance with an embodiment.

FIG. 4 shows leveling belt apparatus and system in accordance with an embodiment. In particular, FIG. 4 shows a diagrammatical side view of a leveling belt apparatus and system 400 leveling radiation curable ink, and pinning the leveled ink. The radiation curable ink leveling system 400 may include a plurality of rolls such as roll 401 and roll 403. The roll 401 may be a tension roll, which may be arranged to function a backing member defining a nip with a dampening system. The roll 403 may be a cooling roll, which may be formed by, for example, a heat pipe. The roll 403 may constitute one of two or more nip roll that define a leveling nip with a backing member.

The leveling belt 405 may comprise an inner layer and an outer layer. The outer layer may face a leveling nip defined by the leveling belt and a backing member. The inner layer of the belt 405 may be constructed to be supportive and resistant to photodegradation. For example, the inner layer may comprise TEFLON FEP.

The leveling belt 405 may include an outer layer being a conformable coating. The conformable coating may be a UV clear elastomeric coating for conformance. The UV transmissive conformable coating may include silicone formed as an outer layer over the inner layer. The conformable coating may also include reinforcing filler and/or reinforcing resin. Reinforcing filler may comprise a fumed silica, or nanocrystalline silica. The UV clear elastomeric coating may include a reinforcing resin. The reinforcing resin may include a highly-branched and highly-crosslinked and/or small chain siloxanes.

Figure 5:
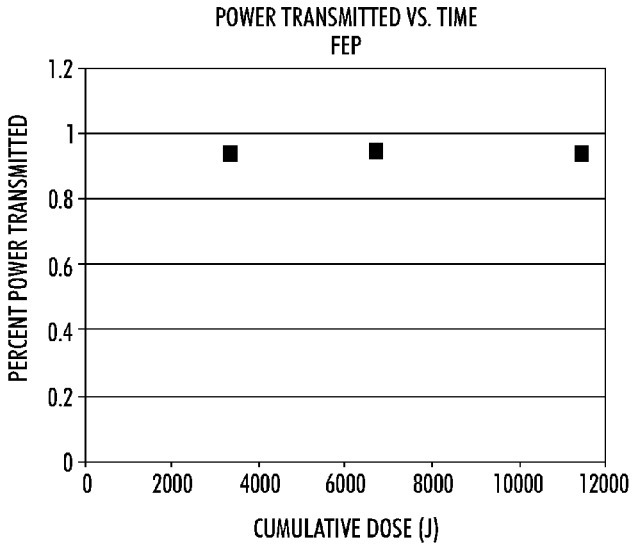
FIG. 5 shows a graph depicting FEP transmission over time.

FIG. 5 shows that a light transmission of TEFLON FEP is high, and consistently so with no noticeable change in color of the material. FIG. 5 shows that transmission of power stays constant over time during exposure to light. The results shown in FIG. 5 were achieved by taking measurement of samples exposed over an EIT powermap passed under an LED device. FEP is suitable for its optical clarity and resistance to photodegradation.

Figure 6A:
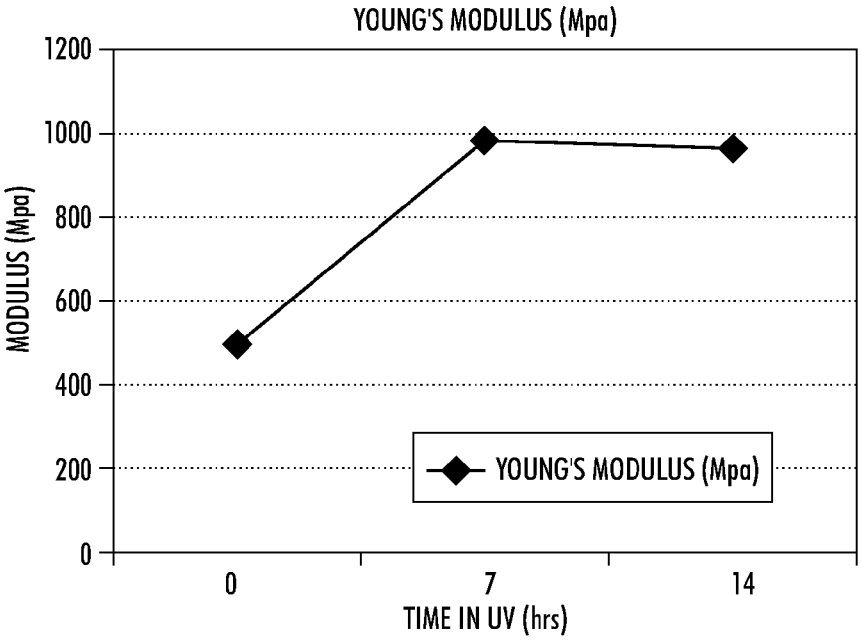
FIG. 6A shows a graph depicting stiffness of FEP over time.
Figure 6B:
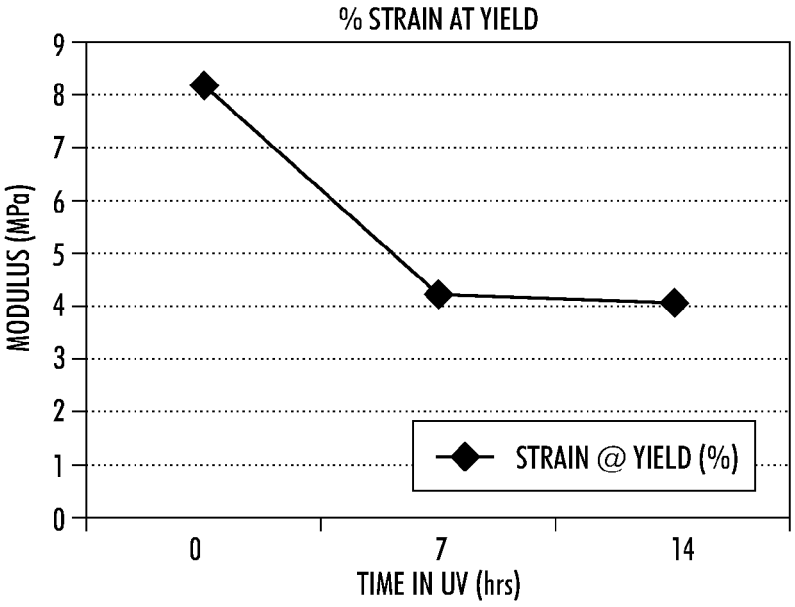
FIG. 6B shows a graph depicting strain of FEP over time.

It has been found that mechanical properties of the inner layer comprising TEFLON FEP are consistent over time during light exposure. FIG. 6A shows that mechanical properties are sufficient for low pressure (about 20 psi) leveling at room temperature, for example. FIG. 6A shows that after about 7 hours of exposure to UV light, a Young's modulus stabilized and remained substantially constant. FIG. 6B shows that after about 7 hours of UV exposure, a percent strain at yield remained substantially constant. It has been found that leveling and simultaneous cure of gel ink with a TEFLON belt may enable printing of ink lines without offset onto the leveling member despite the tendency of typically gel inks to adhere to a surface of the leveling member, particularly as the ink cools and becomes more viscous after heated jetting.

It has been found that the leveling member should include a conformable surface to enable uniform spreading of ink lines on a substrate at the leveling nip. Otherwise, ink lines having a jagged non-uniform appearance may result in image quality defects. It has been found that a conformable surface enables acceptable line width for enhanced final print image quality. As such, a leveling member may include an outer layer formed on the hard inner layer, the outer laying being a conformable surface.

Figure 7A:
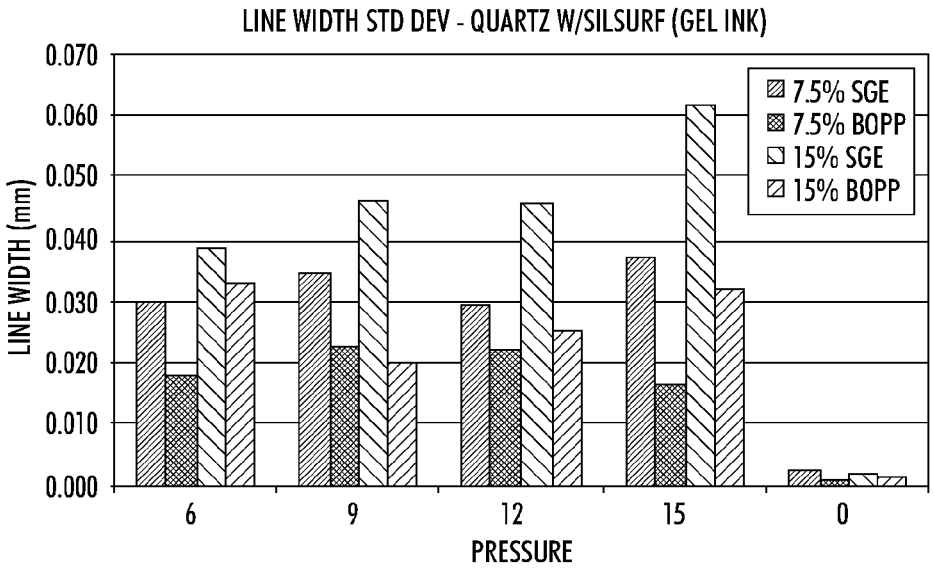
FIG. 7A shows a graph depicting jetted ink line width standard deviation using a a hard leveling member and fountain solution at certain leveling pressures.

A conformable surface enables acceptable line width for enhanced final print image quality having uniform gloss, uniform lines, and no offset onto the leveling member. For example, FIG. 7A shows a graph of line width standard deviation for gel ink deposited on different substrates and leveled using a hard surface leveling member such as a quartz leveling member surface having a film of fountain solution metered thereon. The hard-surface quartz leveling member enables effective curing of gel ink in a leveled state, and enables contact-leveling at a leveling nip with no offset of the ink onto a leveling member. FIG. 7A shows the results of leveling 7.5% and 15% gel ink on semi-gloss elite paper (SGE) and biaxially oriented polypropylene (BOPP) substrates. Pressures are reported in PSI, and line width standard deviation is reported in millimeters for each of FIGS. 7A-7C.

Figure 7B:
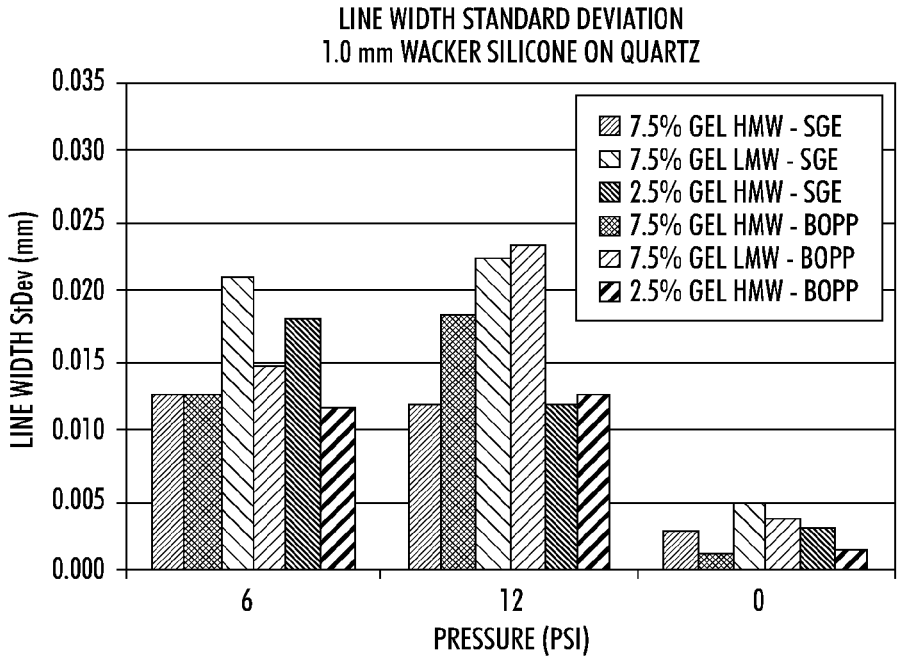
FIG. 7B shows a graph depicting a jetted ink line width standard deviation using a leveling member having a silicone layer at certain leveling pressures.

FIG. 7B shows the results of leveling 2.5% and 7.5% gel on SGE and BOPP substrates at various pressures. The ink was leveled and cured at the leveling nip using a leveling member having quartz and a conformable surface comprising silicone elastomer. In particular, the results shown in FIG. 7B were produced using a leveling member having a 0.5 mm thick WACKER silicone layer on surface of thereof. In comparison with FIG. 7A, the data shows that a conformable surface improves line quality of ink lines leveled and cured at a contact-leveling nip. The graphs show relative standard deviations in line width that are substantially smaller for prints produced using a leveling member having a conformable surface. Standard deviation of line width is a measure of the variation in line width of a line measured in multiple locations by way of a PIAS-II analyzer. For FIGS. 7A, 7B, and 7C, zero pressure indicates an as-jetted condition. The standard deviation of line width shown in FIG. 7B is generally smaller than that shown in FIG. 7A, suggesting that a leveling member conformable coating or silicone-comprising surface layer enhances image quality by ensuring that lines jetted onto a substrate surface are straight and evenly printed.

Figure 7C:
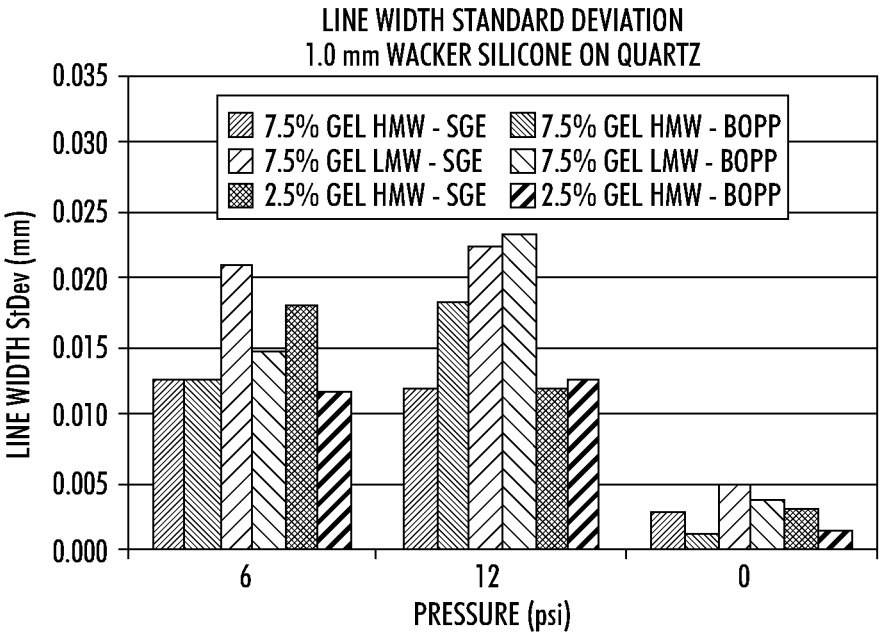
FIG. 7C shows a graph depicting a jetted ink line width standard deviation using a leveling member having quartz and a conformable surface comprising silicone elastomer.

FIG. 7C shows the results of leveling 2.5% and 7.5% gel on SGE and BOPP substrates at various pressures. The ink was leveled and cured at the leveling nip using a leveling member having quartz and a conformable surface comprising silicone elastomer. In particular, the results shown in FIG. 7C were produced using a leveling member having a 1.0 mm thick WACKER silicone layer on surface of thereof. In comparison with FIG. 7A, the data shows that a conformable surface improves line quality of ink lines leveled and cured at a contact-leveling nip. The graphs show relative standard deviations in line width that are substantially smaller for prints produced using a leveling member having a conformable surface. The standard deviation of line width shown in FIG. 7C is generally smaller than that shown in FIG. 7A, suggesting that a leveling member conformable coating or silicone-comprising surface layer enhances image quality by ensuring that lines jetted onto a substrate surface are straight and evenly printed. Further, in comparison with the results shows in FIG. 7B, FIG. 7C shows that a conformable surface layer that is thicker than 0.5 mm may result in line width standard deviation that is smaller than line width standard deviations found for gel ink lines printed using a leveling member having a surface layer that is 0.5 mm thick. For example, FIG. 7C shows that improved line uniformity may be achieved with leveling members having a 1 mm thick surface layer than with leveling members having a 0.5 mm surface layer, with respect to, for example, 7.5% gel ink printed on SGE or BOPP.

The conformable coating or outer layer on the belt 405 may include a silicone layer. It has been found that silicones used as photovoltaic encapsulates work well. For example, room temperature vulcanized silicone such as WACKER RT-601 is suitable. Other silicones that provide the same function may also be suitable, including those silicones provided by Dow Corning such as Sylgard 182 or 184. Other silicones that are clear to UV are also suitable photovoltaic encapsulates or the conformable coating, silicone having a hardness of roughly Shore A 40. Particularly preferred conformable formable coatings include reinforcing fillers such as nanocrystalline or fumed silica. Coatings may include reinforcing resin such as a highly branched and/or highly cross-linked siloxanes and/or small chain siloxanes or Q-resin.

It may be desirable to include an adhesion layer for bonding the silicone to the TEFLON FEP. Although an adhesive will likely reduce transmission of light through the leveling member 405, the coating may be formed to be a thin film, and heat buildup may be compensated for by suitable cooling methods. Adhesive treatments that may be used for bonding silicones to TEFLON FEP may include corona treatment or a radiation-based exposure such as plasma etching, or UV/ozone, which may have the effect of creating functional bond sites on a surface of the quartz. Alternatively, a silane adhesive may be used as an intermediate bonding layer, or primer, interposing the TEFLON FEP and silicone layers.

As shown in FIG. 4, system 400 may include a backing member system 417 including a belt entrained by backing member rollers. The belt of the backing system 417 may be loaded against the leveling member 405 to form a fixed dwell region providing roughly 100 millimeters of contact dwell. The dwell region may include a leveling region and a pre-cure region, following the leveling region in a process direction.

A media path such as a web path 420 may be configured to carry media through the leveling nip defined by the leveling member 405 and the backing member 417. The media may be substrate such as a paper, which may be carried through the media path 420 during a print run. Ink may be heated and deposited by a print head onto a surface of the medium. Ink may be heated for jetting, and may cool upon contacting the substrate. As the ink cools, the ink may have a tacky consistency that renders the ink susceptible to offset onto a leveling member at a leveling nip. The ink may be contact-leveled as desired and cured while the ink is in a leveled state to harden the ink using the light source 135.

A light shield 431 may be disposed within the quartz tube of the leveling member 401. The light shield 431 may be disposed to prevent light from passing through the quartz tube and into the leveling nip at the leveling region thereby preventing premature or undesired curing before adequate leveling. A light source 435 may be disposed within the leveling member 401. The light source may be a UV source, for example, or a LED array. The light source 435 may be configured to emit light into the leveling nip at the pre-cure region shown in FIG. 4. As an ink-bearing side of substrate 423 having tacky ink 425 deposited thereon approaches and then passes through the leveling nip ink 425 may be leveled by way of pressure applied to the ink against the substrate by way of the leveling member 401 and backing member pressure belt 415. As the leveled ink image passes through a remainder of the leveling nip, and into a pre-cure region of the leveling nip, light may be emitted by light source 435 into the pre-cure region of the leveling nip for curing the leveled ink 425 while the ink is in a leveled state.

Systems may include the backing system 417 including a platen 421. The platen 421 may be chilled. The platen 421 may be shaped for enhancing leveling at the leveling nip defined by the belt 405 and the backing member 417 accordingly to a desired pressure profile.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A leveling apparatus useful for printing radiation curable ink on a substrate, comprising:

a leveling belt, the leveling belt having an inner layer and an outer layer, the outer layer forming a conformable belt surface for contacting a radiation curable ink-bearing side of the substrate at a leveling nip; the inner layer comprising:

fluorinated ethylene propylene; and the outer layer comprising silicone, a reinforcing filler, the reinforcing filler comprising nanocrystalline silica or a highly-branched siloxane, and a reinforcing resin;

a plurality of support rolls configured to entrain the belt, the plurality of rolls including a tension roll, and a dampening system backing roll, the dampening system being configured to apply dampening fluid for radiation curable ink printing, at least two of the plurality of rolls being configured to support the belt to form a leveling nip; and a light source disposed to interpose the belt and the leveling nip, the light source being configured to emit light through the belt at the leveling nip.

2. The apparatus of claim 1, wherein the reinforcing filler comprises fumed silica.

3. The apparatus of claim 1, comprising the light source being a ultra-violet light source.

4. The apparatus of claim 1, the light source further comprising a light-emitting diode array.

5. The apparatus of claim 1, the light source being configured to emit light having a wavelength of 395 nm for pinning radiation curable ink.

6. The apparatus of claim 1, comprising:

a dampening fluid delivery system configured to apply dampening fluid to the outer layer.

7. The apparatus of claim 5, wherein the light source is external to the plurality of rolls, and disposed within a circumference of the belt.

* * * * *